US010137487B2

(12) United States Patent
Park et al.

(10) Patent No.: US 10,137,487 B2
(45) Date of Patent: Nov. 27, 2018

(54) APPARATUS AND METHOD FOR MANUFACTURING BLADE

(71) Applicant: KOREA INSTITUTE OF MACHINERY & MATERIALS, Daejeon (KR)

(72) Inventors: Jong-Kweon Park, Daejeon (KR); Seung Kook Ro, Daejeon (KR); Sung Cheul Lee, Daejeon (KR); Shiv G. Kapoor, Champaign, IL (US); James Zhu, Woodbury, MN (US)

(73) Assignee: KOREA INSTITUTE OF MACHINERY & MATERIALS, Daejeon (KR)

( * ) Notice: Subject to any disclaimer, the term of this patent is extended or adjusted under 35 U.S.C. 154(b) by 133 days.

(21) Appl. No.: 14/926,082

(22) Filed: Oct. 29, 2015

(65) Prior Publication Data

US 2017/0120468 A1 May 4, 2017

(51) Int. Cl.

| | |
|---|---|
| ***B21C 1/18*** | (2006.01) |
| ***B21D 3/12*** | (2006.01) |
| ***B21D 53/64*** | (2006.01) |
| ***B26B 21/58*** | (2006.01) |
| ***B26B 9/00*** | (2006.01) |
| ***C22C 45/00*** | (2006.01) |
| ***B26B 21/40*** | (2006.01) |

(52) U.S. Cl.

CPC ..... *B21C 1/18* (2013.01); *B21D 3/12* (2013.01); *B21D 53/64* (2013.01); *B26B 9/00* (2013.01); *B26B 21/4068* (2013.01); *B26B 21/58* (2013.01); *C22C 45/00* (2013.01)

(58) Field of Classification Search

CPC ..... B26B 21/4068; C22C 1/002; B21D 11/02; B21D 25/00; B21D 25/02; B21D 3/12; B21D 53/64; B21D 53/642; B21D 53/645; B21D 53/347; B21D 53/647; B21F 5/005; B21F 5/00; B21C 1/16; B21C 1/18

USPC ..... 72/302, 377, 378

See application file for complete search history.

(56) References Cited

U.S. PATENT DOCUMENTS

| | | | | |
|---|---|---|---|---|
| 7,574,884 | B2 * | 8/2009 | Carsley | B21D 26/055 29/421.1 |
| 2009/0056402 | A1 * | 3/2009 | Boesch | B21D 3/10 72/316 |
| 2012/0000052 | A1 * | 1/2012 | Bailey | B01D 29/012 29/428 |

FOREIGN PATENT DOCUMENTS

| | | |
|---|---|---|
| KR | 10-0943015 | 2/2010 |
| WO | 2012/115944 | 8/2012 |

* cited by examiner

*Primary Examiner* — Shelley Self
*Assistant Examiner* — Mohammad Yusuf
(74) *Attorney, Agent, or Firm* — Lex IP Meister, PLLC

(57) ABSTRACT

An apparatus for manufacturing a blade is provided. The apparatus for manufacturing a blade includes: an arm module including a pressing unit pivoting around a first shaft; a molding module including a molding die pressed by the pressing unit and molding bulk metallic glass (BMG) to a blade; and a drawing module pulling an end portion of the BMG exposed to the outside of the molding die to form an edge of the blade, wherein the drawing module includes a pair of drawing tools pulling one end portion of the BMG in two directions.

11 Claims, 11 Drawing Sheets

APPARATUS AND METHOD FOR MANUFACTURING BLADE

BACKGROUND OF THE INVENTION (a) Field of the Invention

The present invention relates to an apparatus and method for manufacturing a blade, and more particularly, to an apparatus and method for manufacturing a blade formed of a bulk metallic glass (BMG).

(b) Description of the Related Art

The bulk metallic glass (BMG) maintains a 100% amorphous phase at room temperature even at a solidification velocity of general mold casting, according to glass forming ability (GFA), having superior strength, hardness, and wear resistance by three or more times to the same alloy-based crystalline material, and an Fe-based BMG has excellent unique soft magnetic properties. In addition, since BMG has high processability, it may be cast to have a complicated shape, and thus interest in BMG has increased in the industry.

Thus, there has been an attempt to manufacture a blade by using BMG, but heat loss occurs during a manufacturing process, so it is difficult to precisely adjust a space of a mold and pressing force, and it is also difficult to sharply manufacture an edge to have a linear shape.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide an apparatus for manufacturing a blade having advantages of manufacturing a blade using bulk metallic glass (BMG).

The present invention has also been made in an effort to provide a method for manufacturing a BMG blade having advantages of high productivity.

An exemplary embodiment of the present invention provides an apparatus for manufacturing a blade, including: an arm module including a pressing unit pivoting around a first shaft; a molding module including a molding die pressed by the pressing unit and molding bulk metallic glass (BMG) to a blade; and a drawing module pulling an end portion of the BMG exposed to the outside of the molding die to form an edge of the blade, wherein the drawing module includes a pair of drawing tools pulling one end portion of the BMG in two directions.

The pair of drawing tools may be driven to pull one end portion of the BMG in two directions positioned to be coplanar and forming a predetermined angle therebetween.

The pair of drawing tools may be disposed to pull both sides of one end portion of the BMG in directions at angles of 45 degrees and −45 degrees with respect to a direction in which the blade extends.

The arm module may further include: a linear driving unit that moves linearly; and a base unit configured to support the pressing unit and the linear driving unit, wherein one side of the pressing unit may be supported by the base unit so as to rotate around a first shaft, and the other side of the pressing unit may be supported by the linear driving unit so as to rotate around a second shaft.

The linear driving unit may be supported by the base unit so as to rotate around a third shaft, and the first shaft, the second shaft, and the third shaft may be parallel to each other.

The arm module may form a closed loop structure, and the linear driving unit may move in a direction perpendicular to the first shaft, the second shaft, and the third shaft.

The molding module may include: an upper support member disposed above the molding die to transmit pressing force from the pressing unit to the molding die; a lower support member supporting the bottom of the molding die; and a guide member provided in the lower support member and configured to guide a movement of the upper support member such that the upper support member pressed by the pressing unit moves linearly.

The molding die may include: an upper molding die configured to mold an upper portion of the blade; and a lower molding die configured to mold a lower portion of the blade.

The molding module may further include a first cartridge heater configured to transmit heat to the molding die.

Each of the pair of drawing tools may include: a claiming unit configured to press one end portion of the BMG; and a driving unit configured to move the clamping unit such that one end portion of the BMG is pulled.

Pressing force of the clamping unit applied to one end portion of the BMG may be adjusted.

Each of the pair of drawing tools may further include a second cartridge heater configured to transmit heat to the clamping unit.

Another embodiment of the present invention provides a method for manufacturing a blade, including: heating bulk metallic glass (BMG); molding the heated BMG to a blade; heating an end portion of an edge side of the blade; and pulling the heated end portion of the edge side of the blade in two directions to form a sharp edge of the blade.

While the edge of the blade is being formed to be sharpened, the heated state of the end portion of the edge side of the blade may be maintained.

In the molding, upper and lower portions of the heated BMG may be pressed to be molded in a molding die.

In the sharpening of the edge of the blade, the upper and lower portions of the end portion of the edge side of the heated blade may be pressed by a pair of drawing dies, and the pair of pressing drawing dies may be subsequently pulled in two directions positioned to be coplanar with a direction in which the blade extends.

In the sharpening of the edge of the blade, both sides of the end portion of the edge side of the blade are pulled in directions at angles of 45 degrees and −45 degrees with respect to the direction in which the blade extends.

The sharpening of the edge of the blade may include: forming a sloped surface of the end portion of the edge side of the heated blade; cooling the end portion of the edge side of the heated blade; and pressing the sloped surface in a first direction to move the cooled end portion of the edge side of the blade in a second direction perpendicular to the first direction.

The sloped surface of may be formed by a drawing die having a protrusion corresponding to the sloped surface.

According to an exemplary embodiment of the present invention, pressing force applied to the molding die molding a blade may be precisely adjusted, and a temperature of the molding die may be adjusted.

Also, according to an exemplary embodiment of the present invention, since end portions of the heated blade are pulled in two directions, an edge of the blade may be manufactured to be sharp in a linear shape.

DETAILED DESCRIPTION OF THE EMBODIMENTS

Figure 1:
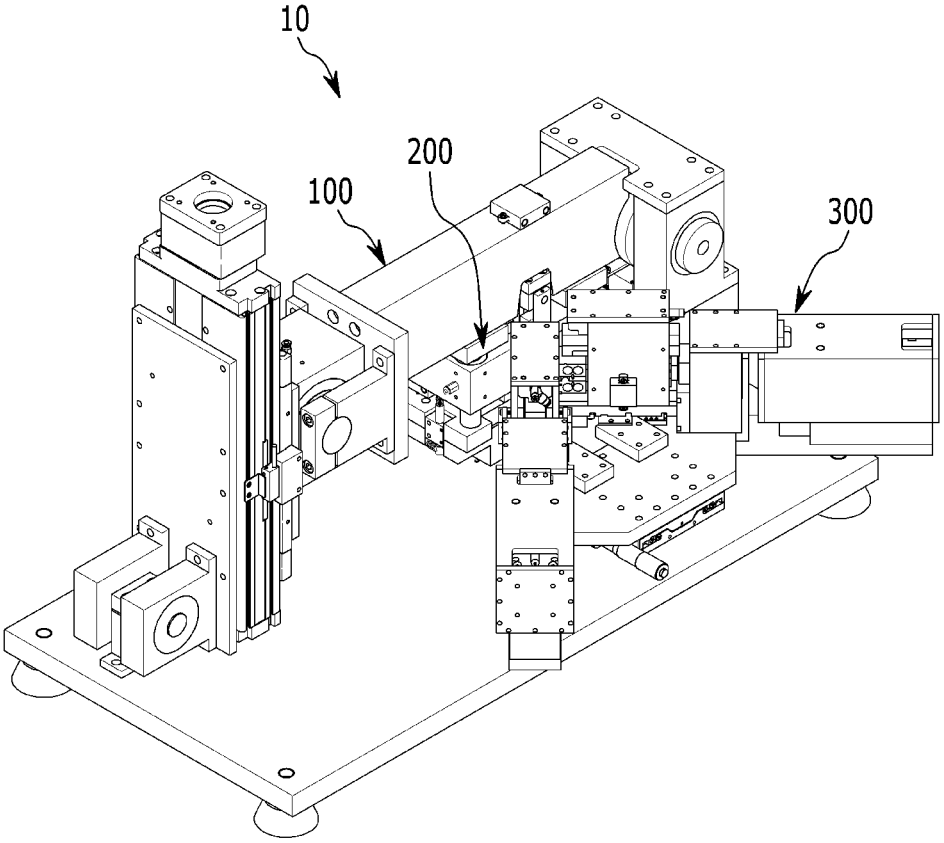
FIG. 1 is a perspective view illustrating an apparatus for manufacturing a blade according to an exemplary embodiment of the present invention.

Hereinafter, the present invention will be described more fully with reference to the accompanying drawings, in which exemplary embodiments of the invention are shown. As those skilled in the art would realize, the described embodiments may be modified in various different ways, all without departing from the spirit or scope of the present invention. The drawings and description are to be regarded as illustrative in nature and not restrictive. Like reference numerals designate like elements throughout the specification.

The present invention relates to an apparatus and method for manufacturing a blade using a bulk metallic glass (BMG), whereby BMG may be heated to be supercooled and subsequently pressed to form a blade, and an end portion thereof may be pulled to form an edge. Here, a sharp edge may be effectively formed by pulling end portions of the BMG in the supercooled state in two directions.

First, the apparatus for manufacturing a blade will be described with reference to the accompanying drawings.

FIG. 1 is a perspective view illustrating an apparatus for manufacturing a blade according to an exemplary embodiment of the present invention.

Referring to FIG. 1, an apparatus 10 for manufacturing a blade according to an exemplary embodiment of the present invention includes an arm module 100, a molding module 200, and a drawing module 300.

The arm module 100 is a part for converting a linear motion into an arc motion and transferring a strong repetitive pressing force to the molding module 200.

Figure 2:
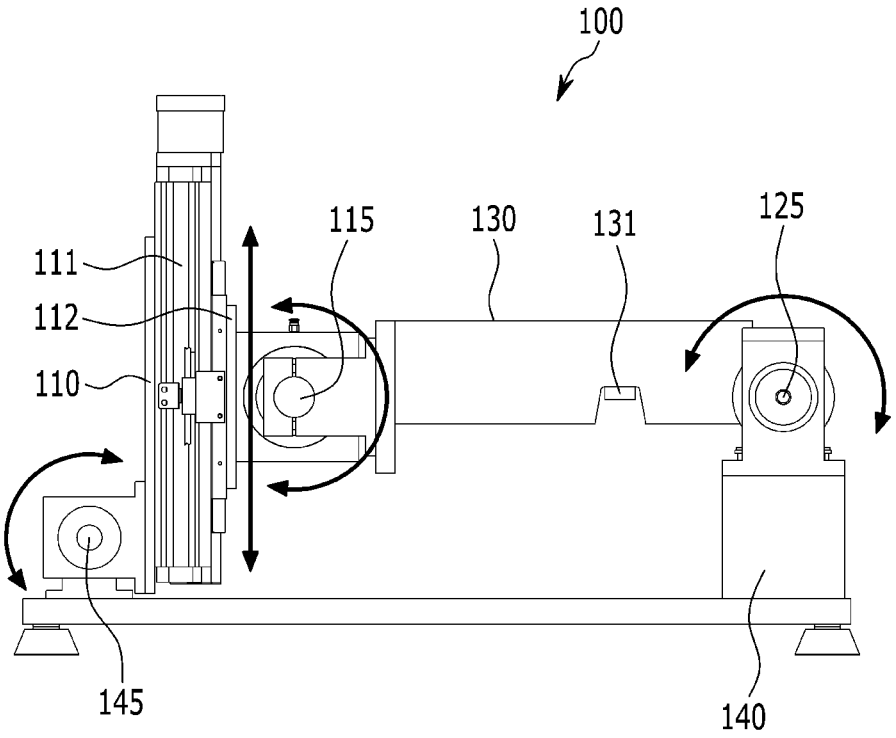
FIG. 2 is a front view of an arm module of the apparatus for manufacturing a blade according to an exemplary embodiment of the present invention.
Figure 3:
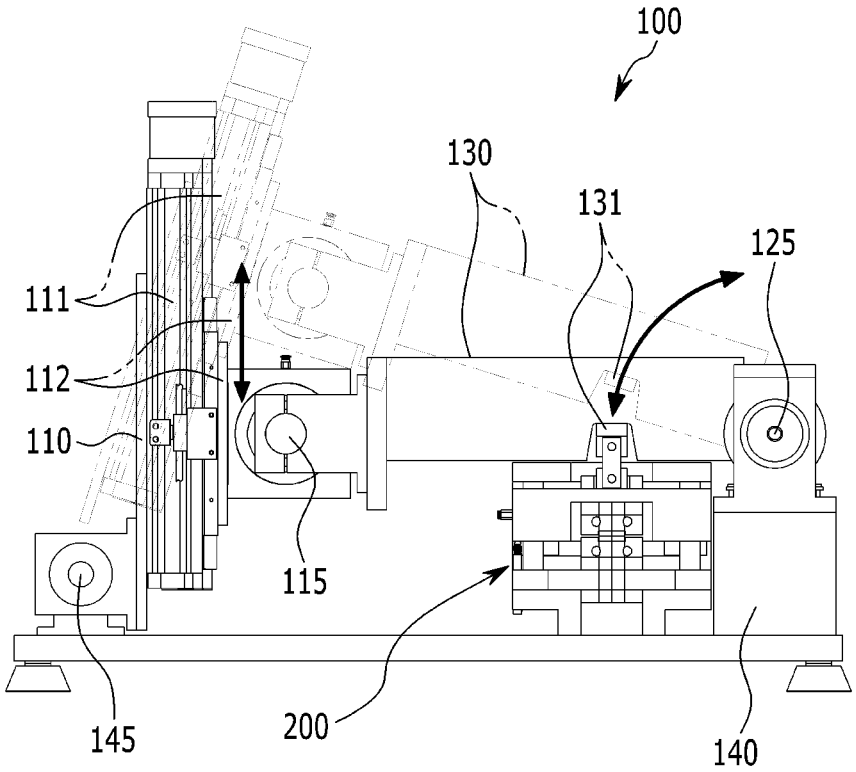
FIG. 3 is a view illustrating an operation of the arm module of the apparatus for manufacturing a blade according to an exemplary embodiment of the present invention.

FIG. 2 is a front view of an arm module of the apparatus for manufacturing a blade according to an exemplary embodiment of the present invention, and FIG. 3 is a view illustrating an operation of the arm module of the apparatus for manufacturing a blade according to an exemplary embodiment of the present invention.

Referring to FIG. 2, the arm module 100 may include a base unit 140, a linear driving unit 110, and a pressing unit 130.

The base unit 140 is a part for supporting the linear driving unit 110 and the pressing unit 130. That is, the base unit 140 may serve to rotatably support the linear driving unit 110 and the pressing unit 130.

The linear driving unit 110 and the pressing unit 130 are connected to each other, and thus, as illustrated in FIGS. 2 and 3, the arm module 110 may form a closed loop structure overall.

The linear driving unit 110 may be supported by the base unit 140 and include a driving member 112 linearly moving along a movement rail 111.

For example, the linear driving unit 110 may be configured as an actuator which is disposed in a vertical direction and linearly moves.

The linearly moving driving member 112 may be connected to one side of the pressing unit 130 such that the driving member 112 rotates around a first shaft 115.

Thus, a linear motion of the driving member 112 may be converted into a pivot motion of the pressing unit 130, that is, specifically, into an arc motion of a pressing recess 131 as illustrated in FIG. 3.

According to an exemplary embodiment of the present invention, the other side of the pressing unit 130 may be connected to the base unit 140 such that the pressing unit rotates about a second shaft 125 arranged to be parallel to the first shaft 115, and the linear driving unit 110 may be connected to the base unit 140 such that the linear driving unit 110 rotates about a third shaft 145 arranged to be parallel to the first shaft 115.

For example, with respect to FIGS. 2 and 3, the pressing unit 130 may be disposed in a horizontal direction to connect the linear driving unit 110 installed in a vertical direction on one side of the base unit 140 and the other side of the base unit 140.

Thus, the arm module 100 may form a pivot link structure through three parallel shafts, while forming a closed loop structure overall.

Referring to FIG. 3, the aforementioned closed loop and pivot link structure may easily convert a linear motion of the linear driving unit 110 into a pivot motion of the pressing unit 130, and may effectively press the molding module 200 to be described hereinafter.

In detail, compared with a case in which the molding module 200 is pressed through a simple linear motion or a rotational motion without the closed loop and pivot link structure, strong pressing force may be generated and repeatability of repeating predetermined pressing force may be enhanced through the closed loop and pivot link structure.

As mentioned above, the arm module 100 presses the molding module 200.

To this end, referring to FIG. 3, the molding module 200 may be disposed below the pressing unit 130, for example, within the arm module 100 having a closed loop structure.

Also, the pressing recess 131 may be formed in the pressing unit 130 of the arm module 100, and may press the molding module 200.

The molding module 200 is a part for molding BMG into a blade using pressing force transferred from the arm module 100.

Figure 4:
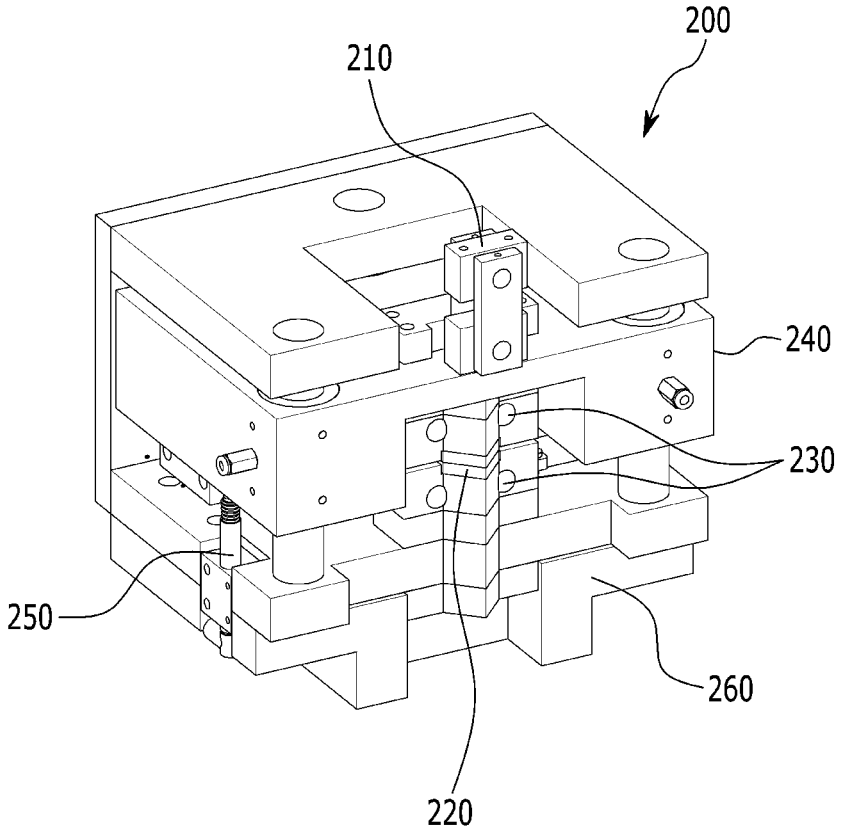
FIG. 4 is a perspective view of a molding module of the apparatus for manufacturing a blade according to an exemplary embodiment of the present invention.
Figure 5:
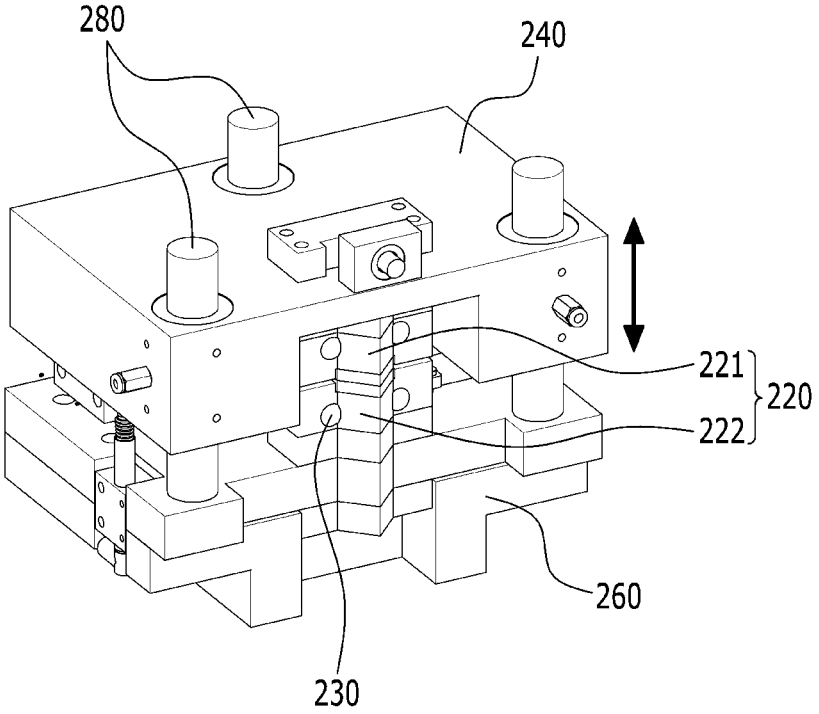
FIG. 5 is a view illustrating an operation of the molding module of the apparatus for manufacturing a blade according to an exemplary embodiment of the present invention.

FIG. 4 is a perspective view of a molding module of the apparatus for manufacturing a blade according to an exemplary embodiment of the present invention, and FIG. 5 is a view illustrating an operation of the molding module of the apparatus for manufacturing a blade according to an exemplary embodiment of the present invention.

Referring to FIG. 4, the molding module 200 may include a molding die 220, an upper support member 240, and a lower support member 260.

The molding die 220 is a part for inserting BMG and molding the BMG into a blade.

The molding die 220 may be pressed by the pressing unit 130 of the aforementioned arm module 100. For example, the molding die 220 may be pressed by pressing force applied by the upper support member 240 positioned above the molding die 220.

Here, the bottom of the molding die 220 may be supported by the lower support member 260.

According to an exemplary embodiment of the present invention, the upper support member 240 may transfer pressing force to the molding die by linearly moving toward the lower support member 260.

For example, referring to FIG. 5, guide members 280 may be formed in the lower support member 260 and extend upwardly so as to be inserted into the upper support member 240.

Accordingly, since the upper support member 240 may make a linear motion toward the lower support member 260, the molding die 220 may be stably pressed.

The molding mole 220 may include an upper molding die 221 and a lower molding die 222, and BMG in the form of a plate member may be inserted therebetween.

Thus, since the upper molding die 221 and the lower molding die are pressed to each other, the plate type BMG positioned therebetween may be molded to a blade.

Here, referring to FIG. 4, the molding module 200 may include a displacement sensor 250.

The displacement sensor 250 may measure linear displacement of the upper molding die 221 and the lower molding die 222 of the molding module 200, whereby pressing force pressing the molding die 220 may be precisely adjusted.

Meanwhile, in order to mold the BMG to a blade, the BMG needs to be heated to be supercooled, and to this end, a unit for transferring heat to the molding die 220 is required.

Thus, according to an exemplary embodiment of the present invention, the molding module 200 may include a first cartridge heater 230.

For example, referring to FIGS. 4 and 5, the first cartridge heater 230 may be formed as a cartridge inserted into a position adjacent to the molding die 220, but the present invention is not limited thereto, and any unit may be formed in various forms as long as it can transmit heat to heat the molding die 220.

Referring to FIG. 4, the molding die 200 may include a contact member 210 protruding upwardly.

For example, the contact member 210 may be provided on the upper support member 240, and may be formed to correspond to the pressing recess 131 (refer to FIG. 3) of the pressing unit 130 described above.

Thus, the pressing recess 131 may press the contact member 210 positioned therebelow, and pressing force transmitted to the contact member 210 may be transmitted to the molding die 220.

The blade molded through the molding die 220 of the aforementioned molding module cannot have a sharp edge, and thus a unit for sharpening the edge of the blade is required.

For example, in a case in which a surgical blade used for a medical purpose needs to have an edge of a scale of a few nanometers, a sharp edge may be formed in a manner of pulling an end portion of the blade.

The drawing module 300 is a part for performing such a function, and pulls an end portion of the blade molded in the molding module 200 to form an edge of the blade.

Figure 6:
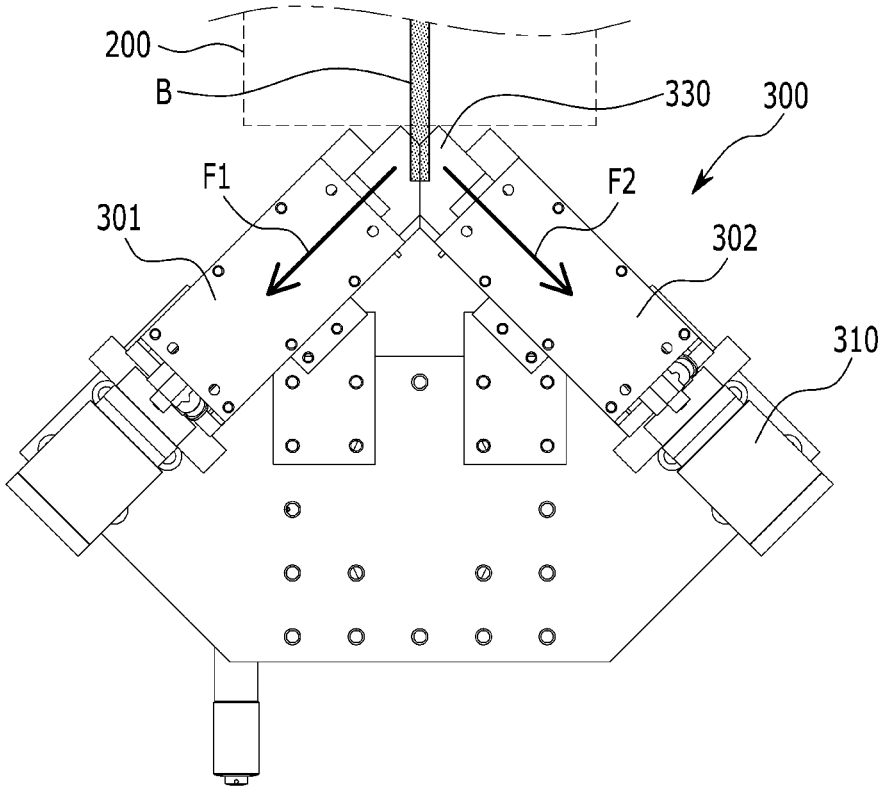
FIG. 6 is a plan view of a drawing module of the apparatus for manufacturing a blade according to an exemplary embodiment of the present invention.
Figure 7:
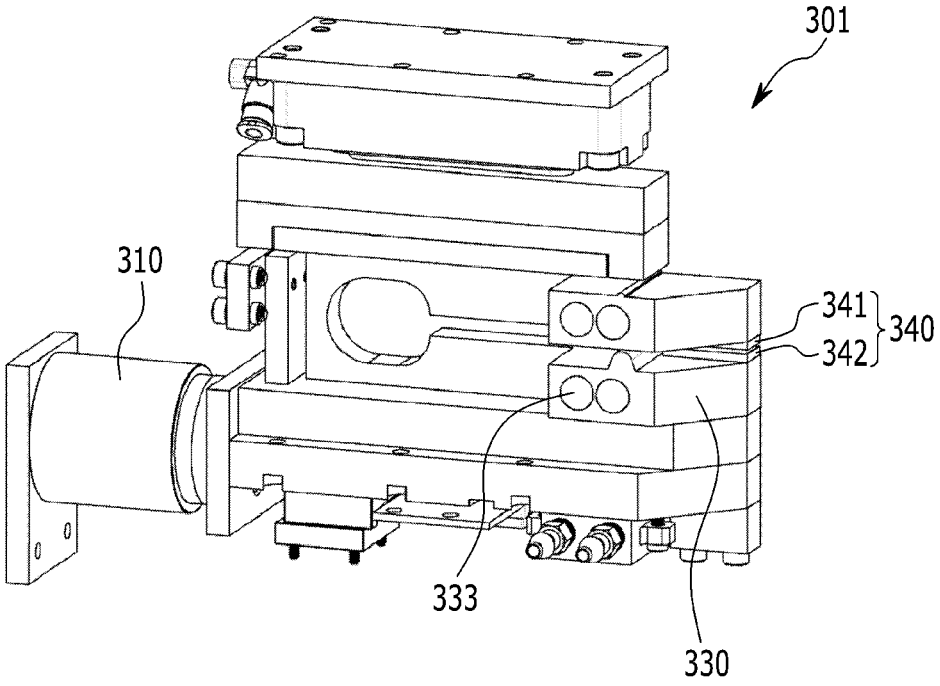
FIG. 7 is a view illustrating a portion of the drawing module of the apparatus for manufacturing a blade according to an exemplary embodiment of the present invention.

FIG. 6 is a plan view of the drawing module of the apparatus for manufacturing a blade according to an exemplary embodiment of the present invention, and FIG. 7 is a view illustrating a portion of the drawing module of the apparatus for manufacturing a blade according to an exemplary embodiment of the present invention.

Referring to FIG. 6, the drawing module 300 pulls an end portion of the blade B exposed to the outside of the molding module 200 in two directions to form an edge of the blade.

In detail, a BMG as a material of the blade is inserted into the molding die 220 of the molding module 200 so as to be molded as a blade, and an end portion of the BMG is positioned to be exposed to the outside of the molding die 220.

The drawing module 300 pulls the end portion of the BMG exposed to the outside of the molding die 220 in two directions.

According to an exemplary embodiment of the present invention, the drawing module 300 is disposed to be adjacent to the molding module 200 (refer to FIG. 1), and as illustrated in FIG. 6, the drawing module 300 may include a pair of drawing tools 301 and 302.

The pair of drawing tools 301 and 302 may be driven to pull an end portion of the BMG exposed to the outside of the molding die 220 in two directions positioned to be coplanar and forming a predetermined angle.

For example, referring to FIG. 6, the end portion of the BMG may be pulled in two directions F1 and F2 positioned to be coplanar with the blade B and forming a predetermined angle with respect to a direction in which the blade B extends.

Processing or pulling the end portion of the BMG in two directions will be described in detail hereinafter.

As illustrated in FIG. 6, the pair of drawing tools are provided, and only one drawing tool 301 will be described and the other drawing tool 302 has the same structure.

Referring to FIG. 6, the drawing tool 301 forming the drawing module 300 may include a clamping unit 330 and a driving unit 310.

For example, the clamping unit 330 may be disposed on one side of the drawing tool 301, and the driving unit 310 may be disposed on the other side of the drawing tool 301.

Thus, the clamping unit 330 clamps the end portion of the BMG, and in this state, the clamping unit 330 linearly moves upon receiving driving force from the driving unit 310.

That is, the clamping unit 330 is a part for pressing and clamping the end portion of the BMG, and the driving unit 310 is a part for providing driving force to enable the clamping unit 330 to linearly move.

According to an exemplary embodiment of the present invention, as illustrated in FIG. 7, a drawing die 340 may be provided in an end portion of the clamping unit 330.

The drawing die 340 may include an upper drawing die 341 and a lower drawing die 342 to press the top and bottom of the end portion of the BMG.

Pressing force of the drawing die 340 applied to the end portion of the BMG may be precisely adjusted, and in order to stably clamp the end portion of the BMG, a protrusion may be formed.

According to an exemplary embodiment of the present invention, the clamping unit 330 may include a second cartridge heater 333.

Thus, when the clamping unit 330 presses the end portion of the BMG, heat may be transmitted to the end portion of the BMG.

For example, the second cartridge heater 333 may transmit heat to the drawing die 340 to maintain a temperature appropriate for the end portion of the BMG pressed by the clamping unit 330 to be deformed.

Meanwhile, the driving unit 310 provides driving force enabling the clamping unit 330 to linearly move.

For example, the driving unit 310 may include a driving motor, a unit for converting driving force from the driving motor into driving force of a linear motion, and a guide unit guiding the clamping unit 330 to linearly move.

As described above, the pair of drawing tools 301 and 302 of the drawing module 300 may be disposed with a predetermined angle therebetween to pull the end portion of the BMG in two directions.

According to an exemplary embodiment of the present invention, the pair of drawing tools 301 and 302 may be disposed at an angle ranging from 60 degrees to 120 degrees.

That is, an angle between the pair of drawing tools 301 and 302 may be adjusted according to shapes of an edge of a blade to be manufactured.

For example, the pair of drawing tools 301 and 302 may be disposed at an angle of 90 degrees.

Alternatively, according to an exemplary embodiment of the present invention, the pair of drawing tools 301 and 302 may be disposed in at angles ranging from 30 degrees to 60 degrees and −30 degrees to −60 degrees with respect to a direction in which the blade extends.

For example, the pair of drawing tools 301 and 302 may be disposed at angles of 45 degrees and −45 degrees with respect to the direction in which the blade extends.

Thus, both ends of the end portion of the BMG may be pulled in the direction of the angles of 45 degrees and −45 degrees with respect to the direction in which the blade extends.

According to an exemplary embodiment of the present invention, during the pulling process, the heated end portion of the BMG may be cooled such that the portion of the end portion of the BMG pressed by the clamping unit 330 may not be deformed.

To this end, although not shown, the apparatus for manufacturing a blade according to an exemplary embodiment of the present invention may include a cooling unit.

Figure 8:
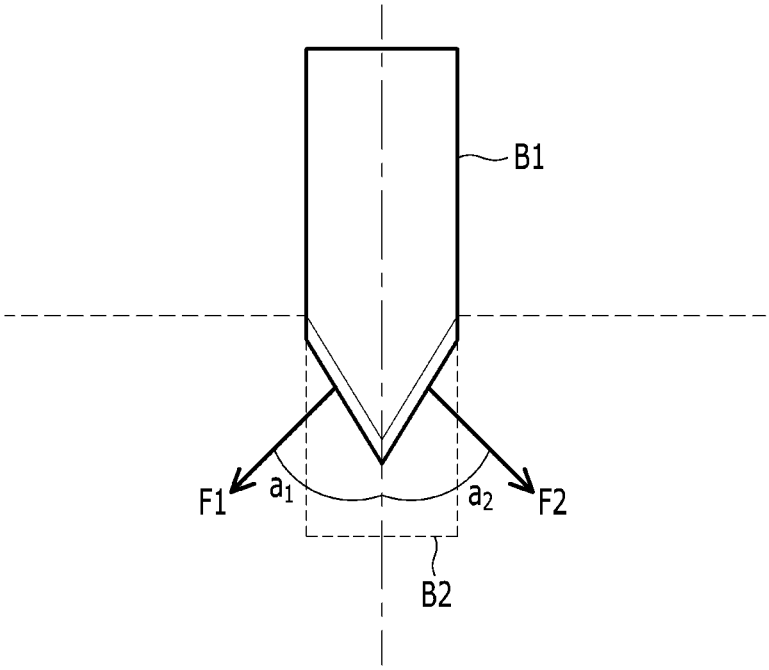
FIG. 8 is a view schematically illustrating formation of an edge of a blade.

FIG. 8 is a view schematically illustrating formation of an edge of a blade.

Referring to FIG. 8, a blade having edges sloped to be bilaterally symmetrical to each other may be manufactured by using the apparatus for manufacturing a blade according to an exemplary embodiment of the present invention.

For example, referring to FIG. 8, the BMG may be divided into a portion B1 inserted into the molding die 220 and a portion B2 exposed to the outside of the molding die 220. The portion B1 inserted into the molding die 220 may be molded in the form of a blade, and the portion B2 exposed to the outside of the molding die 220 may be pulled in two directions F1 and F2 by the pair of drawing tools 301 and 302, thus forming the bilaterally symmetrical edges.

The two directions F1 and F2 in which the portion B2 is pulled by the pair of drawing tools 301 and 302 form angles a1 and a2 with respect to the direction in which the blade extends.

For example, the angles a1 and a2 may be 45 degrees, and under this condition, the edge may be most effectively formed.

In detail, formability of the edge, that is, whether the edge is formed to be sharp enough, may be affected by stress in a direction perpendicular to the edge.

In other words, when the BMG heated to a supercooled state is pulled, necking occurs due to plastic deformation, and the necking is accelerated from a point where normal stress is the greatest within the BMG and propagates perimetrically to form an edge.

When the end portion of the BMG is pulled at an angle of 45 degrees, normal stress is the greatest at the point of the 45 degrees within the BMG, generating necking, and the necking propagates perimetrically to from a sloped edge.

Thus, the blade having sloped edges which are bilaterally symmetrical may be effectively manufactured.

FIG. 8 illustrates a case of having a pair of edge surfaces as an example, but even a blade having a plurality of edge surfaces may be easily manufactured by using the apparatus for manufacturing a blade according to an exemplary embodiment of the present invention.

That is, edges being formed may be variously adjusted in shape by adjusting force and speed in pulling the BMG.

Figure 9:
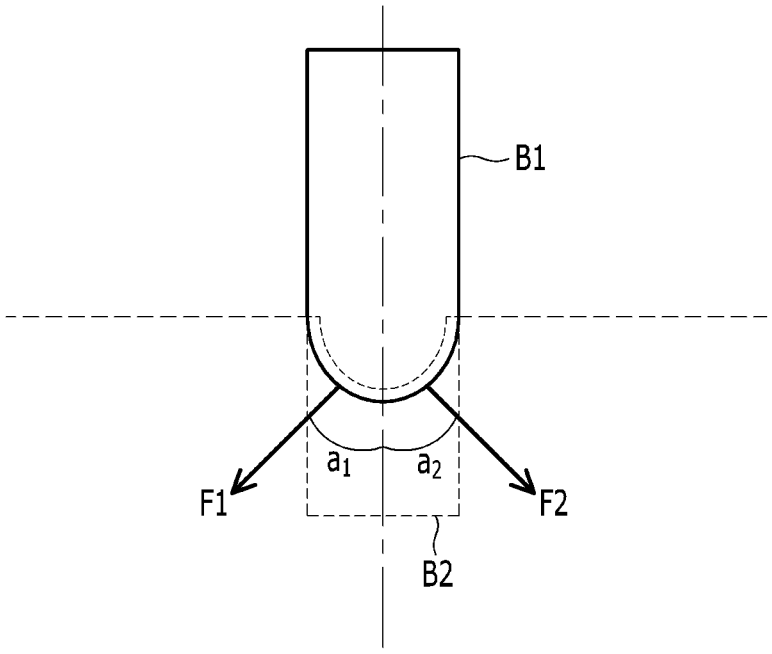
FIG. 9 is a view schematically illustrating formation of an edge of a blade having a different shape.

FIG. 9 is a view schematically illustrating formation of an edge of a blade having a different shape.

Referring to FIG. 9, a blade having curved edges which are bilaterally symmetrical may be manufactured by using the apparatus for manufacturing a blade according to an exemplary embodiment of the present invention.

For example, two directions F1 and F2 in which the portion B2 is pulled by the pair of drawing tools 301 and 302 form angles a1 and a2 with respect to a direction in which a blade extends, and by arranging the angles a1 and a2 at 45 degrees, the edge may be most effectively formed. This has been described above, so detailed description thereof will be omitted.

The blade having the curved edges which are bilaterally symmetrical may be easily manufactured by adjusting force and speed when the end portion of the BMG is pulled at an angle of 45 degrees.

In this manner, the apparatus for manufacturing a blade according to an exemplary embodiment of the present invention may effectively manufacture the blade having sharp edges by using the BMG, enhance repetitive productivity through precise adjustment, and manufacture blades having various edge shapes.

That is, according to an exemplary embodiment of the present invention, the arm module 100 pressing the molding module 200 molding the blade may have a closed structure and a pivot link structure, thus supplying strong force to the molding module 200 repeatedly.

Also, the molding module 200 may precisely adjust pressing force and uniformly maintain a temperature in a supercooled state for molding.

Further, the drawing module 300 may easily form the sharp blade edge by pulling the BMG in two directions.

Hereinafter, a method for manufacturing a blade by using the apparatus for manufacturing a blade according to an exemplary embodiment of the present invention described above will be described in detail with reference to the accompanying drawings.

Figure 10:
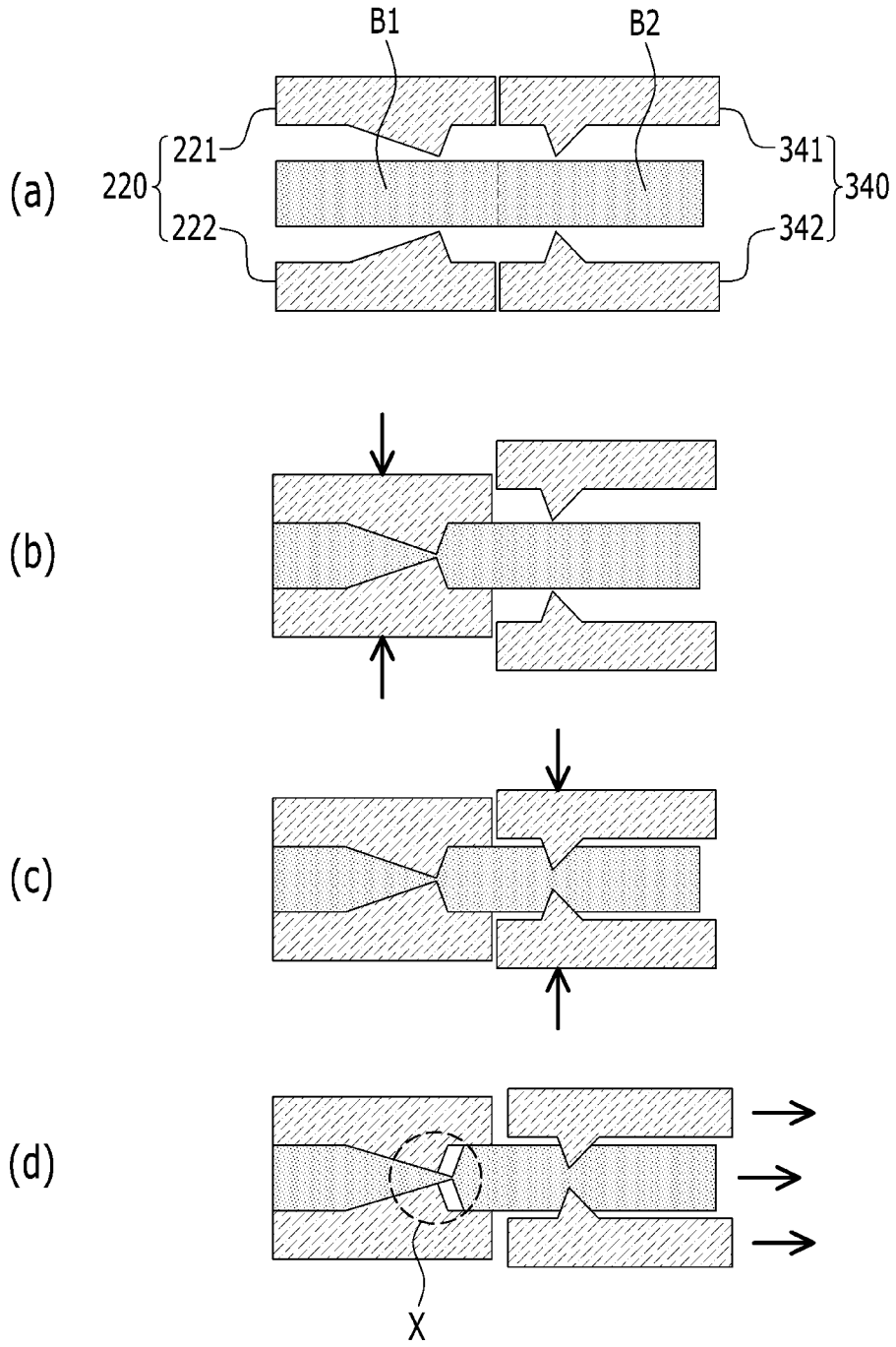
FIG. 10 is a view illustrating a method for manufacturing a blade according to an exemplary embodiment of the present invention.
Figure 11:
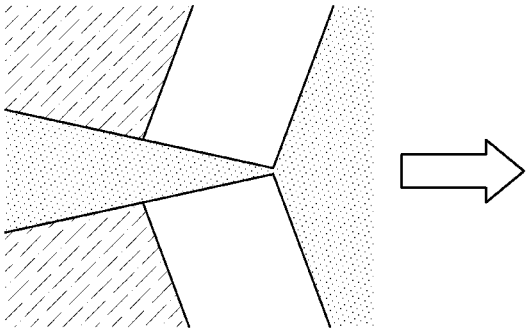
FIG. 11 is an enlarged view of a portion X of FIG. 10.

FIG. 10 is a view illustrating a method for manufacturing a blade according to an exemplary embodiment of the present invention, and FIG. 11 is an enlarged view of a portion X of FIG. 10.

Referring to FIG. 10, in the method for manufacturing a blade according to an exemplary embodiment of the present invention, first, a plate-shaped BMG is prepared and positioned in the molding die 220 ((a) of FIG. 10).

The molding die 220 may include the upper molding die 221 and the lower molding die 222.

For the purposes of description, the BMG may be divided into two sections: the portion B1 inserted into the molding die 220 and positioned between the upper and lower molding dies 221 and 222, and the portion B2 exposed outside of the molding die 220.

According to an exemplary embodiment of the present invention, the portion B1 of the BMG inserted into the molding die 220 is heated.

For example, the BMG is heated to be supercooled.

Subsequently, the molding die 220 is moved in a vertical direction to press the heated BMG ((b) of FIG. 10).

In this manner, the BMG may be molded to a blade. While the BMG is being pressed, the supercooled state of the BMG should be maintained.

To this end, the BMG may be maintained in a supercooled state by using the first cartridge heater 230 (refer to FIGS. 4 and 5) provided in the molding die 220.

After the blade is molded, the portion B2 of the BMG exposed to the outside of the molding die 220 is pressed by using the drawing die 340 ((c) of FIG. 10).

For example, the upper drawing die 341 and the lower drawing die 342 may be pressed in a vertical direction.

Here, the portion B2 exposed to the outside of the molding die 220 is heated such that protrusions of the drawing die 340 are inserted into the BMG.

To this end, the portion B2 of the BMG exposed to the outside of the molding die 220 may be heated by using the second cartridge heater 333 (refer to FIG. 7) supplying heat to the drawing die 340.

Thereafter, an end portion of the BMG pressed by the drawing die 340 is pulled in two directions to form an edge of the blade ((d) of FIG. 10).

Here, the end portion of the BMG may be pulled in two directions positioned to be coplanar with the direction in which the blade extends.

For example, as described above, the end portion of the BMG may be pulled in directions of angles of 45 degrees and −45 degrees with respect to the direction in which the blade extends, thereby easily forming the sharp edge.

The portion B2 of the BMG exposed to the outside of the molding die 220 is pulled in a state in which the protrusions of the drawing die 340 are inserted in the BMG, and the portion B2 may be cooled so as to not be deformed.

To this end, a separate cooling unit may be used.

While the portion B2 of the BMG exposed to the outside of the molding die 220 is being pulled, the portion B1 of the BMG inserted into the molding die 220, where an edge of the blade is to be formed, should be maintained in a supercooled state to cause necking to form an edge.

For example, during the processes of (a), (b), (c), and (d) of FIG. 10, the molding die 220 may be maintained at high temperatures.

Meanwhile, the drawing die 340 may be maintained at a high temperature only during the process of (c) of FIG. 10, and may be maintained at a low temperature during the process of (d) of FIG. 10.

Referring to FIG. 11, the process of sharply forming the edge of the blade through the aforementioned method may be recognized.

According to the method for manufacturing a blade of an exemplary embodiment of the present invention, a blade edge is formed in a state in which both end portions of the BMG are pressed by the pair of molds disposed upward and downward.

For example, the portion B1 of the BMG inserted into the molding die 220 is pressed by the upper molding die 221 and the lower molding die 222, and the portion B2 of the BMG exposed to the outside of the molding die 220 is pressed by the upper drawing die 341 and the lower drawing die 342.

That is, since the drawing process is performed to form the edge in a state in which both upper and lower portions of the both end portions of the BMG are pressed, the edge may be formed in a linear shape, without being deformed such as bent or rolled in one direction.

In other words, if the drawing process is performed in a state in which both the upper and lower portions of the BMG are not pressed and only the upper or lower portion is pressed, the sharp edge having a fine thickness may be formed to be bent or rolled in an upward or downward direction.

Thus, according to the method for manufacturing a blade of an exemplary embodiment of the present disclosure, the edge may be sharpened to have a linear shape, without being bent.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

<Description of symbols>

| | |
|---|---|
| 10 blade manufacturing apparatus | 100 arm module |
| 110 Linear driving unit | 111 movement rail |
| 112 driving member | 115 first shaft |
| 125 second shaft | 130 pressing unit |
| 131 pressing recess | 140 base unit |
| 145 third shaft | 200 molding module |
| 210 contact member | 220 molding die |
| 230 first cartridge heater | 240 upper support member |
| 250 displacement sensor | 260 lower support member |
| 300 drawing module | 301, 302 drawing tool |
| 310 driving unit | 330 clamping unit |
| 333 second cartridge heater | 340 drawing die |

What is claimed is:

1. An apparatus for manufacturing a blade, the apparatus comprising:

an arm module including a pressing unit pivoting around a first shaft;

a molding module including a molding die, wherein the molding die is pressed by the pressing unit and a bulk metallic glass (BMG) is pressed to be molded to a blade in the molding die; and a drawing module pulling an end portion of the BMG exposed to the outside of the molding die to form an edge of the blade, wherein the drawing module includes a pair of drawing tools pulling one end portion of the BMG in two directions so as to generate a necking due to a plastic deformation of the BMG, and wherein the pair of drawing tools pull the one end portion of the BMG in the two directions positioned to be coplanar with a direction in which the blade extends and forming a predetermined angle with respect to the direction in which the blade extends.

2. The apparatus of claim 1, wherein the pair of drawing tools are disposed to pull both sides of one end portion of the BMG in directions at angles ranging from 30 degrees to 60 degrees and ranging from −30 degrees to −60 degrees with respect to the direction in which the blade extends.

3. The apparatus of claim 2, wherein the arm module further comprises:

a linear driving unit that moves linearly; and a base unit configured to support the pressing unit and the linear driving unit, wherein one side of the pressing unit is supported by the base unit so as to rotate around the first shaft, and the other side of the pressing unit is supported by the linear driving unit so as to rotate around a second shaft.

4. The apparatus of claim 3, wherein:

the linear driving unit is supported by the base unit so as to rotate around a third shaft; and the first shaft, the second shaft, and the third shaft are parallel to each other.

5. The apparatus of claim 4, wherein the linear driving unit moves in a direction perpendicular to the first shaft, the second shaft, and the third shaft.

6. The apparatus of claim 1, wherein the molding module comprises:

an upper support member disposed above the molding die to transmit pressing force from the pressing unit to the molding die;

a lower support member supporting the bottom of the molding die; and a guide member provided in the lower support member and configured to guide a movement of the upper support member such that the upper support member pressed by the pressing unit moves linearly.

7. The apparatus of claim 1, wherein the molding die comprises:

an upper molding die configured to mold an upper portion of the blade; and a lower molding die configured to mold a lower portion of the blade.

8. The apparatus of claim 1, wherein the molding module further comprises a first cartridge heater configured to transmit heat to the molding die.

9. The apparatus of claim 1, wherein each of the pair of drawing tools comprises:

a clamping unit configured to press one end portion of the BMG; and a driving unit configured to move the clamping unit such that one end portion of the BMG is pulled.

10. The apparatus of claim 9, wherein pressing force of the clamping unit applied to one end portion of the BMG is adjusted.

11. The apparatus of claim 9, wherein each of the pair of drawing tools may further include a second cartridge heater configured to transmit heat to the clamping unit.

* * * * *